US005700105A

United States Patent [19]

Salice

[11] Patent Number: 5,700,105

[45] Date of Patent: Dec. 23, 1997

[54] MOUNTING PLATE PAIR FOR THE FASTENING OF HINGE ARMS OF FURNITURE HINGES OR SIMILAR

[75] Inventor: Luciano Salice, Carimate, Italy

[73] Assignee: Arturo Salice S.p.A., Novedrate, Italy

[21] Appl. No.: 647,808

[22] Filed: May 15, 1996

[30] Foreign Application Priority Data

May 18, 1995 [DE] Germany ..... 29508286 U

[51] Int. Cl.[6] ..... A47B 96/00; E05D 5/00

[52] U.S. Cl. ..... 403/408.1; 403/405.1; 16/382

[58] Field of Search ..... 403/408.1, 407.1, 403/405.1, 294; 16/382, 383

[56] References Cited

U.S. PATENT DOCUMENTS

| | | | |
|---|---|---|---|
| 4,800,625 | 1/1989 | Salice | 16/382 |
| 4,881,296 | 11/1989 | Marinoni | 16/382 X |
| 4,982,476 | 1/1991 | Salice | 16/382 |

FOREIGN PATENT DOCUMENTS

| | | | |
|---|---|---|---|
| 1287472 | 1/1969 | Germany . | |
| 1559892 | 2/1970 | Germany . | |
| 1708244 | 8/1971 | Germany . | |
| 2128619 | 1/1973 | Germany . | |
| 3604984 | 8/1987 | Germany . | |
| 482899 | 1/1970 | Sweden | 16/382 |

*Primary Examiner*—Anthony Knight

*Attorney, Agent, or Firm*—Dilworth & Barrese

[57] ABSTRACT

The invention relates to a mounting plate pair for the fastening of hinge arms of furniture hinges or similar having two base plates (1) with cylindrical extensions (5, 6) standing at right-angles on these and provided with boreholes (3, 4) and which can be inserted into through-holes (7, 8) of a wall (9) from opposite sides and two top plates overlapping or covering at least partially each of the base plates (1) with fastening boreholes consisting of oblong holes (27, 28) which lie lengthways on a common center line (29) and into which screws (34, 40) gripping in the boreholes (3, 4) of the extensions (5, 6) can be screwed, one of which screws (34) in each case penetrates one of the boreholes (3) in the screwed-in state.

20 Claims, 2 Drawing Sheets

MOUNTING PLATE PAIR FOR THE FASTENING OF HINGE ARMS OF FURNITURE HINGES OR SIMILAR

BACKGROUND OF THE INVENTION

The invention relates to a mounting plate pair for the fastening of hinge arms of furniture hinges or similar.

Particularly in the manufacture of furniture the need exists to fasten metal fitting parts to furniture walls such as, for example, partition walls of cupboards, on both sides where said metal fitting parts serve the holding of connecting elements and preferably of hinge arms.

Mounting plate pairs in twin fixing of the type described above which allow the mounting of fastening elements on opposite sides of a furniture wall are known, for example, from DE-PS 17 08 244 and DE-AS 21 28 619.

The object of the invention is to create on opposite sides of a plate or furniture wall easily and quickly mounted mounting plates which allow an easily performed adjustment of the elements they bear.

SUMMARY OF THE INVENTION

This object is solved in accordance with the invention by a mounting plate pair for the fastening of hinge arms of furniture hinges or similar comprising two base plates with two cylindrical extensions standing at right angles on these, said extensions being provided with boreholes and being able to be inserted into through-holes of a wall from opposite sides, and two top plates overlapping or covering each of the base plates at least partially and being provided with fastening boreholes consisting of oblong holes where said fastening boreholes lie lengthways on a common center line and into which screws can be screwed which grip in boreholes of the extensions of which screws at least one penetrates one of the boreholes in the screwed-in state. The twin mounting plates in accordance with the invention can be mounted simply and quickly in through-holes of plates or furniture walls by one fastening screw in each case bracing together the cone-shaped extensions lying flush to each other in the through-holes while the other shorter fastening screw only serves the fixing in place and holding of the top plate which is provided with fastening means for the holding of the hinge arm. In order to be able to adjust the top plates after the mounting of the mounting plates, which comprise the base plates and the top plates which cover these at least in part, these can be pushed along the length of the oblong holes after slightly loosening the fastening screws and fixed in place by tightening the fastening screws.

In accordance with a particularly preferred embodiment of the invention it is provided that one borehole of each base plate is surrounded at least partially by a collar-shaped base which penetrates the relevant oblong hole so that the head of the fastening screw screwed into this borehole is supported on the base. In this embodiment of the invention the screw screwed into the borehole provided with the collar-shape base braces together the cone-shaped extensions located and lying flush to each other in a through-hole of the furniture wall so that this screw which only serves the fixing in position of the mounting plates in the through-holes of the furniture wall does not also additionally brace the top plate with the base plate and the top plate can be pushed relative to the collar-shaped base in the oblong hole this surrounds and the fixing in place of the top plate on the base plate is performed only by the other screw which can only be screwed so far into the boreholes of the one extensions of the base plate that this does not obstruct the screwing in of the screw which serves the bracing of the extensions from the other end.

A base plate which can be combined with a furniture wall by fastening screws is known already from DE-PS 36 04 984 on which said base plate a top plate covering this is held in oblong holes allowing adjustment and fixing in place where two boreholes of the base plate are surrounded at least partially by collar-shaped bases which extend into the oblong holes of the top plate supported on the base plate and which penetrate the oblong holes so that while the fastening screws screwed into the boreholes provided with bases serve the fastening of the base plate, they do not brace the top plate with the base plate. In order to brace the top plate with the base plate, a third bracing screw is provided which serves only the fixing in place of the top plate on the base plate.

Appropriately, each oblong hole enclosing a base is designed as a rectangle. Accordingly, the bases can possess a rectangular cross-section with a width adapted to the width of the oblong hole.

Each base plate can possess an essentially rectangular circumference shape.

A further embodiment of the invention provides that the cylindrical extensions of each base plate possess a different height. In this way, it is possible to take the circumstance into account that essentially only the longer cone-shaped extension serves the bracing in the through-hole of the furniture plate and the shorter extension flush with this is only braced with the longer extension in an axial direction by the fastening screw penetrating it.

Appropriately, the longer fastening screw fitted in the borehole of the cylindrical extension with the lower height possesses a non-threaded shaft part contacting at its head whose length essentially corresponds to the length of the borehole.

As the longer fastening screw serves the axial bracing of the extensions flush in the through-holes of the furniture wall, the head of the longer fastening screw is supported on the base surrounding the borehole.

The wall of the end segment of the borehole of the longer cylindrical extension can be provided with at least one lengthways slit so that the end segment of this extension is spread dowel-like by the fastening screw screwed into it.

As the longer cylindrical extension serves the bracing in the through-hole its slit segment can be provided with peripheral ring-shaped circumferential sawtooth-shaped rises.

In accordance with a particularly preferred embodiment it is provided that the shaft part of the longer fastening screw which connects to the non-threaded shaft part and which is provided with a self-tapping thread is provided with chamfers on opposite sides. This embodiment allows fast mounting in that the section of the fastening screw provided with the thread portion and already mounted in the shorter extension is only pressed into the borehole of the longer shaft part in one end-side borehole section with lateral indentations so that a fixing in place of the twin mounting plates is only made by a quarter turn. Thanks to the self-tapping threads the extensions inserted flush to each other in the through-hole are pulled against each other and braced with each other. A good spread of the slit borehole section is achieved by the cross-section of the borehole being adapted to that of the screw in said section.

Appropriately, the head of the longer fastening screw is provided with radial extensions and the top plate with stops for these in such a way that the fastening screw can only be turned by around 90° between its insertion position in the borehole of the longer extension and its position where it spreads this.

The stops for the radial extensions of the head of the fastening screw can be formed by the walls of an indentation of the top plate in whose bottom the oblong hole is located.

The shorter screw which can be screwed into the borehole of the longer extension from the base plate side serves appropriately only the bracing of the top plate with the base plate.

The shorter plate is also appropriately a self-tapping screw.

A further embodiment of the invention provides that the top plate comprises an elongated center part with a direction diagonal to that of the base plate and essentially rectangular in shape and wing-like lateral extensions set centrally to these which are provided with oblong holes. The top plate can be provided with edges bent down against the furniture wall in the area of the extension so that the base plate is not visible in the mounted state.

A further embodiment of the invention provides that the base plate is designed mirror-symmetrically to its longitudinal central plane. In this way, the twin metal fitting can comprise two identical base plates which simplifies the mounting and the support.

The top plate, too, is appropriately symmetric to its plane running through the common central line of the oblong holes so that it is designed identically both to the left stop and the right stop of hinge arms. In addition, a symmetry appropriately also exists of the top plate to the plane running through the rectangular center part.

BRIEF DESCRIPTION OF THE DRAWINGS

One embodiment of the invention is described below in detail by means of the drawing in which.

DESCRIPTION OF THE PREFERRED EMBODIMENTS

Figure 2:
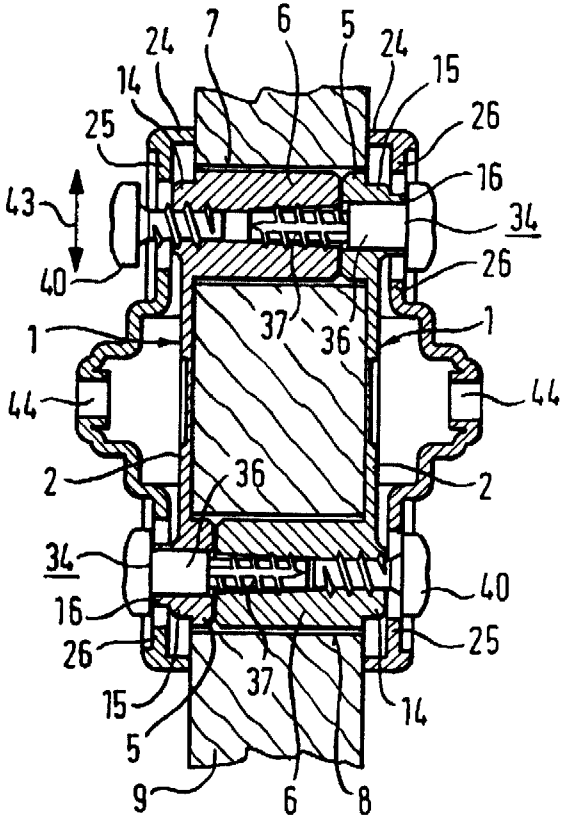
FIG. 2 is a representation corresponding to that of FIG. 1 where the fastening screw bracing the left top plate with the base plate is partially loosened.
Figure 1:
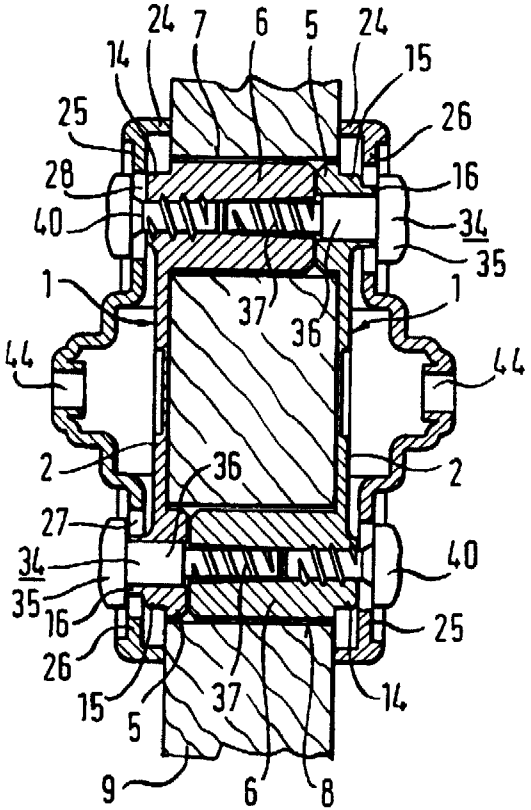
FIG. 1 shows a longitudinal section through the twin metal fitting in accordance with the invention in the state mounted on a furniture wall where the two top plates are braced with the base plate by fastening screws.

Each of the two base plates visible and designed identically in the twin combination in FIGS. 1 and 2 consists of an essentially rectangular plate 2 provided at its end segments with diagonal boreholes 3, 4. The boreholes 3, 4 penetrate cone-shaped or cylindrical extensions 5, 6 located on the bottom side at the end segments of the plate 2 and formed in one piece (in material homogeneity) with the base plate 2. The extension 6 is several times longer than extension 5.

The extension 5 of lower height possesses a smooth, circumferential wall whose diameter is adapted to the diameter of the two through-holes 7, 8 of the furniture wall 9. The longer extension 6 is provided in its area near the plate 2 with a smooth-walled borehole section 4'. This borehole section 4' is in contact with a borehole section 4" over whose length the cylindrical wall encompassing the borehole of extension 6 is provided with slits 10 opposite each other and running lengthways. On their outer side the extension 6 is provided in its lower section with a sawtooth-like profile 11.

Figure 4:
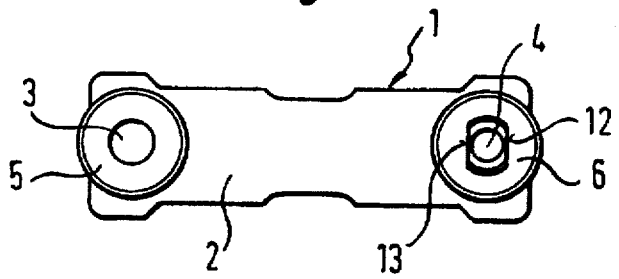
FIG. 4 is a bottom view of a base plate.
Figure 5:
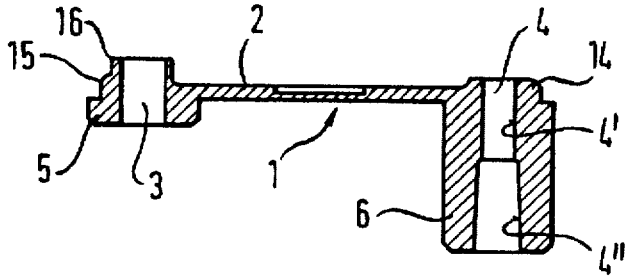
FIG. 5 is a longitudinal section through a base plate.
Figure 6:
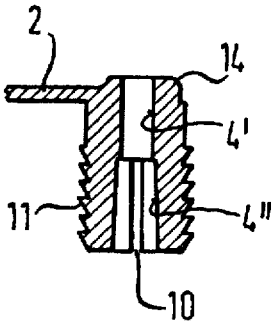
FIG. 6 is a longitudinal section through the longer, dowel-like extension of the base plate.
Figure 7:
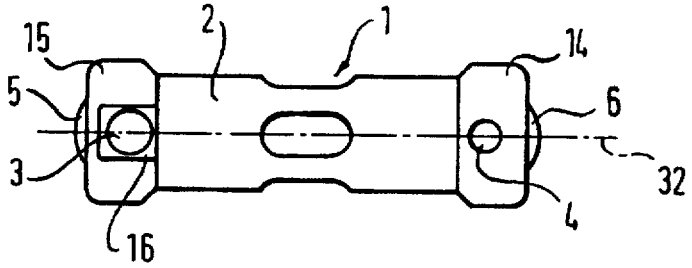
FIG. 7 is a top view of the base plate.

The borehole section 4" provided with the lengthways slits 10 is provided on opposite sides with chamfers 12, 13 in the way shown in FIG. 4. The chamfers 12, 13 are located in unslit segments of the wall.

The base plate 2 is provided on its side opposite the extensions 5, 6 with base-like elevations 14, 15 where the base-like elevation 15 opposite the shorter extension is provided with a further base 16 rectangular in cross-section which encompasses the borehole 3.

The base plate 1 is overlapped in the mounted state by the top plate 20 which comprises an essentially rectangular center part 21 and wing-like extensions 22, 23 set at the side and center of these. The wing-like extensions 22, 23 and the connecting lateral parts of the center part 21 are provided with an edge 24 angled downwards.

The wing-like extensions 22, 23 are provided with indentations 25, 26 in whose bottom oblong holes 27, 28 are located which lie lengthways on a common center line 29. The oblong hole 27 is penetrated in the mounted state seen in FIGS. 1 to 3 by the base 16 forming a collar of the borehole 3. The width of the oblong hole 27 is coordinated to the width of the base 16 so that this contacts the side edges of the oblong hole.

The base-like elevations 14, 15 of the base plate 1 possess an approximately rectangular circumferential shape where the narrow side edges are roughly in the area of the angled-down edges 24 of the wing-like extensions 22, 23.

The base plate 1 is designed symmetrically to its longitudinal center plane 32. The top plate 20 is also symmetrical to the center plane 29 and also designed symmetrically to the diagonal center plane 33 except for the form of the oblong holes.

Figure 8:
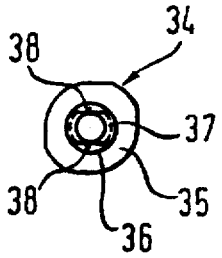
FIG. 8 is a bottom view of the longer fastening screw.
Figure 9:
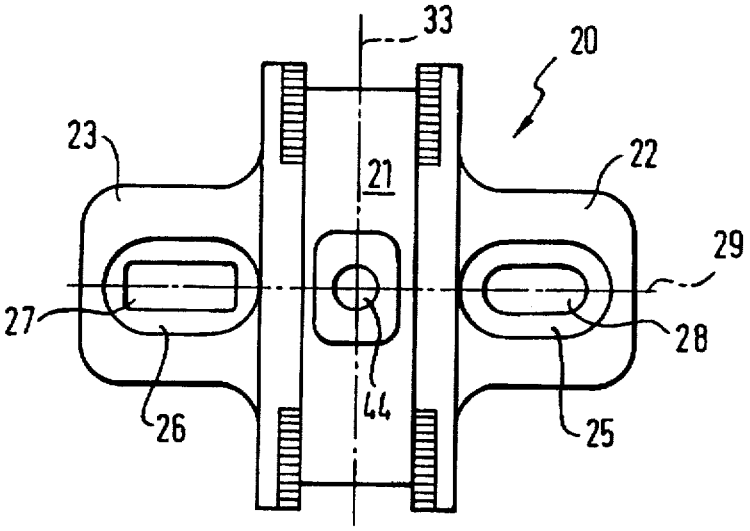
FIG. 9 is a top view of the top plate in the state removed from the base plate.

The fastening screw 34 serving the bracing of the cone-like extensions 5, 6 possesses at the end of its head 35 a non-threaded shaft part 36 with which it essentially penetrates the borehole 3 of the extension 5 of lower height. To this non-threaded shaft part a shaft part 37 with a self-tapping thread contacts which is provided in the way visible from FIG. 8 with chamfers 38 on sides lying opposite each other.

The head 35 of the longer fastening screw 34 is provided with radial extensions and the top plate 20 is provided with stops for these, in such a way that the fastening screw 34 can only be turned by around 90° between its insertion position in the bore hole 4" of the longer extension 6 and its position where it spreads this.

The fastening screw 40 serving only the bracing of the top plate 20 with the base plate 1 is a self-tapping screw and can be screwed from plate part 2 so far into the borehole 4' that it ends before the spread borehole part 4". The lengths of the two fastening screws 34, 40 are coordinated in such a way with each other that they cannot collide in their braced state.

The two identically designed mounting plate parts which are fitted in boreholes 7, 8 of the wall 9 are supplied in such a way in a pre-mounted state that the fastening screws are fitted in the boreholes of the base plate and fix the top plate in position on the base plate in the normal mounting position. For the mounting of the mounting plate pair it is thus only necessary to insert the cone-shape extensions into the boreholes 7, 8 and to press them together in such a way that the shaft pan 37 provided with thread of the fastening screws 34 grips in the borehole section 4 provided with corresponding indentations. With a quarter turn of the longer fastening screws 4, the cylindrical extensions are then braced with each other and in the boreholes.

Figure 3:
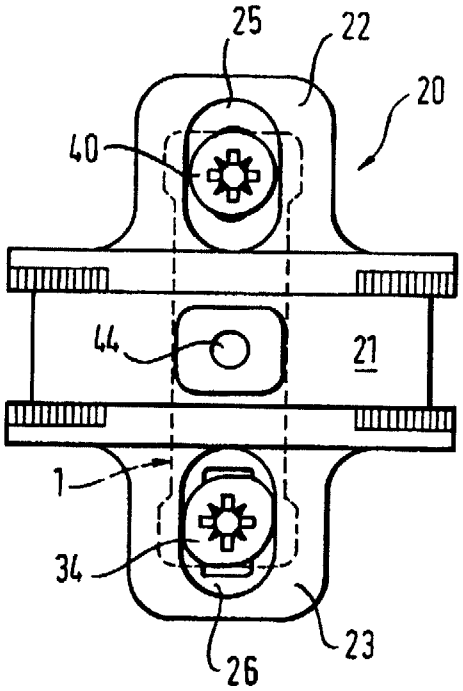
FIG. 3 is a top view of a top plate, covering a base plate

If a further adjustment of the top plate is subsequently necessary, the corresponding fastening screw 40 is loosened so that the top plate 20 can be pushed in the direction of the double arrow 43 in FIG. 3 into the desired position at which then the fastening screw is again tightened.

The center part 21 of the top plate is provided with base-like elevations whose central one is provided with a fastening borehole 44 for a hinge arm.

I claim:

1. A mounting plate pair for the fastening of hinge arms of furniture hinges or similar, comprising two base plates (1) with cylindrical extensions (5, 6) standing at right-angles on these and provided with boreholes (3, 4) and able to be fitted from opposite sides into through-holes (7, 8) of a wall (9), and two top plates (20) overlapping or covering at least in part each of the base plates (1), the top plates (20) being provided with fastening means (44) for securing the hinge arms, the top plates (20) each comprising oblong fastening holes (27, 28) arranged lengthways on a common center line (29) and into which screws (34, 40) comprising a longer screw (34) and a shorter screw (40) gripping in the boreholes (3, 4) of the extensions (5, 6) can be screwed, of which the longer screw (34) in each case penetrates through one of the boreholes (3) of the first base plate (1) and enters the other of the boreholes (4) of the oppositely-arranged second base plate (1) in the screwed-in state, wherein in the screwed-in state, one of the extensions (5, 6) of the first base plate (1) and one of the extensions (6, 5) of the oppositely-arranged second base plate (1) are in alignment in one of said through-holes (7, 8), thus forming an extension-pair, and the extensions (5, 6) of each extension-pair are braceable to one another by means of the first, longer screw (34) inserted from the side of the first base plate (1), while the second, shorter screw (40) inserted from the side of the oppositely-arranged second base plate (1) serves to fix the therewith associated top plate (20) to the second base plate (1).

2. A mounting plate pair in accordance with claim 1, characterized in that one borehole (3) of each base plate (1) is surrounded at least in part by a collar-shaped base (16) which penetrates the corresponding oblong hole (27) so that a head (35) of the fastening screw (34) fired in this borehole (3) is supported on the base (16).

3. A mounting plate pair in accordance with either of claim 2, characterized in that each oblong hole (27) encompassing a base (16) has a rectangular design.

4. A mounting plate pair in accordance with claim 3, characterized in that the base (16) possesses a rectangular cross-section with a width corresponding to the width of the oblong hole (27).

5. A mounting plate pair in accordance with claim 1, characterized in that each base plate (1) possesses an essentially rectangular circumferential shape.

6. A mounting plate pair in accordance with claim 1, characterized in that the cylindrical extensions (5, 6) of each base plate possess different heights.

7. A mounting plate pair in accordance with claim 6, characterized in that the longer fastening screw (34) screwed into the borehole (3) of the cylindrical extension (5) with lower height penetrates said extension and serves the bracing of the flush extensions (5, 6).

8. A mounting plate pair in accordance with claim 6, characterized in that the longer fastening screw (34) inserted into the borehole of the cylindrical extension (5) with a lower height possesses a non-threaded shaft part (36) contacting its head where the length of said non-threaded shaft part (36) corresponds essentially to the length of the borehole (3).

9. A mounting plate pair in accordance with claim 2, characterized in that the head (35) of the longer fastening screw (34) is supported on the base (16).

10. A mounting plate pair in accordance with claim 6, characterized in that a wall of an end segment of the borehole (4") of the longer cylindrical extension (6) is provided with at least one lengthways slit (10).

11. A mounting plate pair in accordance with claim 6, characterized in that the longer cylindrical extension (6) possesses a peripheral area (4") having ring-shaped, circumferential, sawtooth-shaped rises (11).

12. A mounting plate pair in accordance with claim 1, characterized in that the longer fastening screw (34) comprises a shaft part (37) provided with a self-tapping thread and which contacts a non-threaded shaft part (36) thereof which is provided on opposite sides with chamfers (38).

13. A mounting plate pair in accordance with claim 6, characterized in that a head (35) of the longer fastening screw (34) is provided with radial extensions and the top plate (20) is provided with stops for these in such a way that the fastening screw (34) can only be turned by around 90° between its insertion position in the borehole (4") of the longer extension (6) and its position where it spreads this.

14. A mounting plate pair in accordance with claim 13, characterized in that the stops are formed by walls of an indentation (26) of the top plate (20) in whose bottom the oblong hole (27) is located.

15. A mounting plate pair in accordance with claim 6, characterized in that the shorter screw (40) which can be screwed from the base plate (2) side into the borehole (4') of the longer extension (6) serves the bracing of the top plate (20) with the base plate (1).

16. A mounting plate pair in accordance with claim 1, characterized in that the shorter screw (40) is a self-tapping screw.

17. A mounting plate pair in accordance with claim 1, characterized in that the top plate (20) comprises an elongated, essentially rectangular center part (21) diagonally to the base plate (1) and wing-like extensions (22, 23) set laterally and centrally on this where said extensions are provided with the oblong holes (27, 28).

18. A mounting plate pair in accordance with claim 17, characterized in that the top plate (20) is provided in the area of the lateral, wing-like extensions (22, 23) with edges (24) bent down against the furniture wall (9).

19. A mounting plate pair in accordance with claim 1, characterized in that the base plate (1) is designed in a mirror-symmetrical fashion to its longitudinal center plate (sectional plane).

20. A mounting plate pair in accordance with claim 1, characterized in that the top plate (20) is symmetrical to its plane running through the common center line (29) of the oblong holes (27, 28).

* * * * *